US006527086B2

(12) United States Patent
Oh

(10) Patent No.: US 6,527,086 B2
(45) Date of Patent: Mar. 4, 2003

(54) OIL SUPPLY DEVICE FOR CLOSED RECIPROCATING COMPRESSOR

(75) Inventor: IL-Kyo Oh, Kwangju (KR)

(73) Assignee: Samsung Kwangju Electronics Co., Ltd. (KR)

( * ) Notice: Subject to any disclaimer, the term of this patent is extended or adjusted under 35 U.S.C. 154(b) by 0 days.

(21) Appl. No.: 09/836,263

(22) Filed: Apr. 18, 2001

(65) Prior Publication Data

US 2001/0050200 A1 Dec. 13, 2001

(30) Foreign Application Priority Data

Jun. 13, 2000 (KR) ..... 00-32497

(51) Int. Cl.[7] ..... F01M 1/00
(52) U.S. Cl. ..... 184/6.16; 415/88
(58) Field of Search ..... 184/6.16; 415/88

(56) References Cited

U.S. PATENT DOCUMENTS 3,858,685 A * 1/1975 Bono ..... 184/6.16
5,088,579 A * 2/1992 Kim et al. ..... 184/6.16
5,377,781 A * 1/1995 Yun ..... 184/6.23
6,000,500 A * 12/1999 Oh ..... 184/6.16
2001/0050200 A1 * 12/2001 Oh ..... 184/6.16

* cited by examiner

*Primary Examiner*—David Fenstermacher
(74) *Attorney, Agent, or Firm*—Burns Doane Swecker & Mathis, LLP

(57) ABSTRACT

A closed reciprocating compressor includes a closed container forming an oil storage portion at a lower end thereof. A power generating device disposed in the container reciprocates a piston to compress air. An eccentric shaft is fixed to a lower end of the axle. A hollow oil supply device fixed to the eccentric shaft and extends downwardly therefrom at an oblique angle and into the oil for conducting oil upwardly due to centrifugal force generated in response to rotation of the axle. The oil supply device includes a radially outer portion and a radially inner portion, the radially outer portion being spaced farther from the axis than the radially inner portion. A lower first section of the radially outer portion forms a first acute angle with a horizontal plane and merges at its upper end with a second section of the radially outer portion which forms a second acute angle with the horizontal plane, wherein the second angle is larger than the first angle.

1 Claim, 2 Drawing Sheets

OIL SUPPLY DEVICE FOR CLOSED RECIPROCATING COMPRESSOR

This application claims priority under 35 U.S.C. §§ 119 and/or 365 to patent application Ser. No. 32497/2000 filed in the Republic of Korea on Jun. 13, 2000, the entire content of which is hereby incorporated by reference.

BACKGROUND OF THE INVENTION

1. Field of the Invention

The present invention relates to an oil supply device for a closed reciprocating compressor, and more particularly to an oil supply device for a closed reciprocating compressor to minimize a movement of an oil scum and increase pumping amount during an oil supply by improving a structure of an end portion of the oil supply device installed at an end portion of a rotary axle, thereby minimizing a friction noise.

2. Description of the Background Art

A closed reciprocating compressor generally functions to discharge a coolant to outside in a refrigerating cycle of consecutively performing a compression, condensation, expansion and vaporization by means of the coolant.

As shown in FIG. 3, such a closed reciprocating compressor generally comprises a driving section 20 for generating a power inside of a closed container 10 and a compressing section 30 for compressing a sucked coolant by the power from the driving section 20.

The driving section 20 mounted on an upper part of the closed container 10 includes a stator 21, a rotor 22, and a rotary axle 23 coupled with the rotor 22 to incorporate an eccentric shaft 24.

The compressing section 30 mounted on a lower part of the closed container 10 comprises a cylinder 31 and a cylinder head 32 having a compression compartment for compressing a coolant, a piston 33 for reciprocating inside of the cylinder 31, and a connecting rod 34 for connecting the piston 33 to the eccentric shaft 24.

Oil is stored at a lower part of the closed container 10 and pumped to each sliding section by an oil supply device 40 installed on one side of the eccentric shaft 24 for lubrication and refrigeration.

As shown in FIG. 4, the oil supply device 40 is of a tubular shape slantingly mounted toward a central axis of the rotary axle 23 at an end portion of the eccentric shaft 24.

The closed reciprocating compressor in general as described above generates a magnetic field between the stator 21 and the rotor 22 to rotate the rotary axle 23. The piston 33 connected to the connecting rod 34 on the eccentric shaft 24 of the rotary axis 23 sucks the coolant to compress and discharge by reciprocating inside of the cylinder 31. That is, the coolant is repeatedly sucked, compressed and discharged by a continuous reciprocation of the piston 33.

Also, when a centrifugal force (Equation 1) is added to the oil supply device 40 which is fixed to the eccentric section of the connecting rod 34 driven by the rotation axle 23, refrigerated oil collected at the lower part is supplied to the friction movement area of each device section by an elevating component of a force (Equation 2) generated at that time.

$$F=F_c\cdot\sin\theta\ (F_c=\text{Centrifugal force}) \qquad \text{Equation 1}$$

$$F_c=M\cdot r\cdot\omega^2\ (M=\text{Mass of rotary body, } r=\text{rotating radius}) \qquad \text{Equation 2}$$

However, the oil supply device 40 is slantingly mounted toward the central axis of the rotary axle 23 at the end portion of the eccentric shaft 24 in the closed reciprocating compressor, and is rotated at a high speed by stirring an oil scum when rotating the rotary axle. At this time, the oil supply device 40 periodically stirs the oil scum and generates noise by the irregular movement of the oil scum, which causes increases of the compressor noise and refrigerator noise.

SUMMARY OF THE INVENTION

To resolve the above problems, it is an object of the present invention to improve the structure of an end portion of an oil supply device 40 and generate a magnetic field between a stator 21 and a rotor 22 that rotates a rotary axle 23 by being applied a power. Also, when a centrifugal force is added to the oil supply device 40 which is fixed to a eccentric section of the connecting rod 34 by following the rotation of the rotary axle 23, a refrigerated oil collected in the lower part is supplied to the area of friction movement of each device section by an elevating component of a force (Equation 2) generated at that time.

It is another object of the present invention to minimize the stirring times for refrigerated oil O of the oil supply device 40, and also friction noise and oil noise in a device section of the compressor by increasing oil pumping power.

The structure of the present invention to achieve the above objects includes a closed container 10 for storing oil in the lower part, a driving section 20 mounted in the closed container 10 for generating a motive power and a compressing section 30 for sucking, compressing and discharging the coolant by receiving the motive power of the driving section 20.

The oil supply device for the closed reciprocating compressor includes the rotary axle 23 having an eccentric shaft 24 mounted on the driving section 20 for rotating, and supplies oil to the driving section 20 mounted on the lower end of the eccentric shaft 24 and the compressing section 30, wherein the device is characterized in becoming the smaller in diameter from the upper part to the lower part.

BRIEF EXPLANATION OF THE DRAWINGS

The above objectives and advantages will become more apparent by the following explanation of the invention made with reference to the accompanying drawings, in which.

DETAILED DESCRIPTION OF A PREFERRED EMBODIMENT OF THE INVENTION

An oil supply device for a closed reciprocating compressor according to the present invention will now be explained in detail with reference to the drawings.

Figure 1:
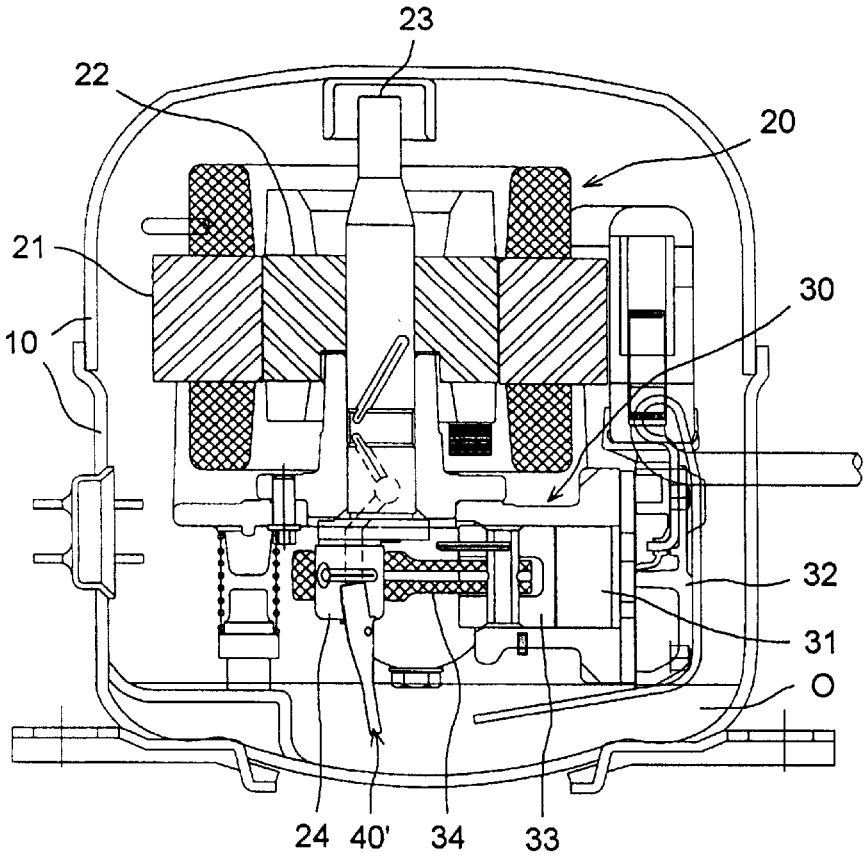
FIG. 1 is a cross-sectional view showing a constitution of a closed reciprocating compressor according to the present invention.

As shown in FIG. 1, the lower part of the closed reciprocating compressor according to the present invention comprises a closed container 10 for storing oil, a driving section 20 for generating a motive power, and a compressing section 30 for sucking coolant by receiving the motive power from the driving section 20 to compress and discharge the coolant with high pressure.

The driving section 20 mounted on the upper part of the closed container 10 includes a stator 21, a rotor 22 and a rotary axle 23 coupled with the rotor 22 to incorporate an eccentric shaft 24 for rotation.

The compressing section 30 mounted on the lower part of the closed container 10 comprises a cylinder 31 and a cylinder head 32 having a compression compartment for compressing coolant after sucking inwardly, a piston 33 for reciprocating the inside of the cylinder 31 and a connecting rod 34 for connecting the piston 33 to the eccentric shaft 24.

The refrigerated oil O is stored in the lower part of the closed container 10, and is supplied to the friction movement area of each device section by the oil supply device mounted at the end portion of the eccentric shaft 24.

Figure 2A:
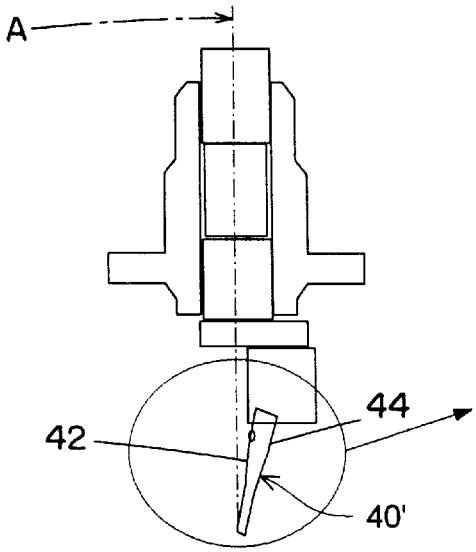
FIG. 2A is a side view of an oil supply device and drive axle of a closed reciprocating compressor according to the present invention.
Figure 2B:
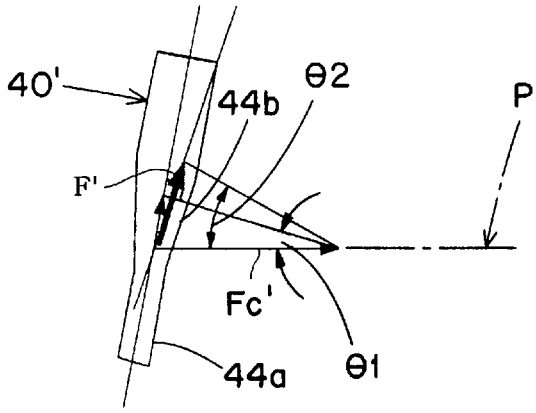
FIG. 2B is an enlarged side view of the oil supply device of FIG. 2A.
Figure 3:
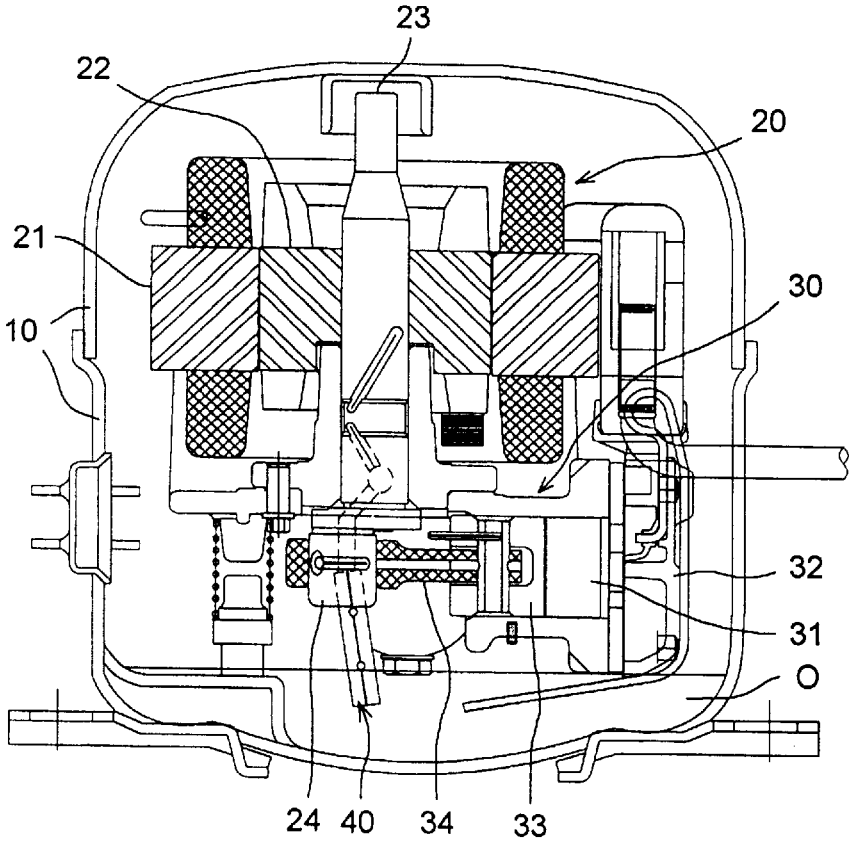
FIG. 3 is a comprehensive cross-sectional view showing a constitution of a closed reciprocating compressor in general.
Figure 4A:
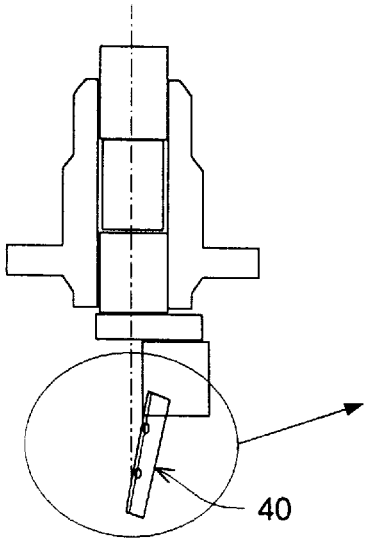
FIG. 4A (PRIOR ART)
FIG. 4A is a side view of an oil supply device closed reciprocating compressor.
Figure 4B:
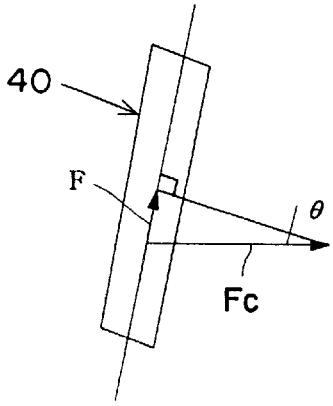
FIG. 4B (PRIOR ART)
FIG. 4B is an enlarged side view of the prior art oil supply device.

Referring to FIG. 2A, the oil supply device 40' is slantingly mounted at an oblique angle toward the central axis A of the rotary axle 23 at an end portion of the eccentric shaft, and the lower part has a smaller diameter than the upper part.

The oil supply device for a closed reciprocating compressor constituted above according to the present invention generates a magnetic field between the stator 21 and the rotor 22 to rotate the rotary axle 23. The piston 33 connected to the connecting rod 34 at the eccentric shaft 24 of the rotary axle 23 sucks the coolant for compression and discharge of the coolant by reciprocating inside of the cylinder 31.

That is, the coolant is repeatedly sucked, compressed, and discharged by the continuous reciprocation of the piston 33.

Meanwhile, a centrifugal force (Equation 4) is added to the oil supply device 40', which is fixed to the eccentric section of the connecting rod 34, in accordance with the rotation of the rotary axle 23. The refrigerated oil stagnant in the lower part is supplied to the friction movement area of each device section by an elevating component of a force (Equation 3) generated at that time.

$$F'=F'_c\cdot\sin\theta \quad (F'_c=\text{Centrifugal force}) \qquad \text{Equation 3}$$

$$F'_c=M\cdot r\cdot\omega_2 \quad (M=\text{Mass of rotary body, } r=\text{rotating radius}) \qquad \text{Equation 4}$$

The oil supply device 40'includes a radially outer portion 44 which is disposed farther from the axis A than is the inner portion 42. A lower first section 44*a* of the radially outer portion 44 forms a first acute angle θ1 with a horizontal plane P. That first section 44*a* merges at its upper end with a second section 44*b* of the outer portion 44, which section 44*b* forms a second acute angle θ2 with the plane P, which second angle θ2 is larger than the first angle.

As described above, the oil supply device of a closed reciprocating compressor according to the present invention provides advantages of reducing the oil stirring noise by minimizing the area immersed into the oil by lessening the diameter of the lower part compared to the upper part of the oil supply device and improving the structure such that an elevating component of a force becomes greater than that of the prior art, thereby increasing an oil pumping amount and reducing the mechanical friction noise with a smooth oil supply.

While the present invention has been described herein with reference to the embodiments thereof, a latitude of modification, various changes and substitutions are intended in the foregoing disclosure. In some instances, some features of the invention will be employed without a corresponding use of other features without departing from the spirit of the invention as set forth herein.

In the claims:

1. A closed reciprocating compressor comprising:

a closed container including an oil storage portion at a lower end thereof;

a power generating device disposed in the container;

a rotary axle connected to the power generating device to be rotated thereby about a vertical axis;

a compressing mechanism including a reciprocating piston operably connected to the axle, for sucking, compressing and discharging coolant;

an eccentric shaft fixed to a lower end of the axle; and a hollow oil supply device fixed to the eccentric shaft and extending downwardly therefrom at an oblique angle relative to the axis and into the oil for conducting oil upwardly due to centrifugal force generated in response to rotation of the axle, the oil supply device including a radially outer portion and a radially inner portion, the radially outer portion spaced farther from the axis than the radially inner portion, a lower first section of the radially outer portion forming a first acute angle with a horizontal plane and merging at its upper end with a second section of the radially outer portion which forms a second acute angle with the horizontal plane, wherein the second angle is larger than the first angle.

* * * * *